US005148150A

United States Patent [19]

White et al.

[11] Patent Number: 5,148,150

[45] Date of Patent: Sep. 15, 1992

[54] COMPACT SECURITY ALARM CIRCUITRY AND APPARATUS FOR PORTABLE CONTAINERS

[75] Inventors: Irving S. White, Los Angeles; Irving Moskovitz, Pacific Palisades, both of Calif.

[73] Assignee: Cra West Incorporation, Los Angeles, Calif.

[21] Appl. No.: 637,672

[22] Filed: Jan. 7, 1991

[51] Int. Cl.[5] ..... G08B 13/14

[52] U.S. Cl. ..... 340/571; 340/568; 340/686; 340/689; 340/693; 200/61.52; 200/61.85

[58] Field of Search ..... 340/571, 568, 573, 686, 340/689, 693; 200/61.45 R, 61.52, 61.85

[56] References Cited

U.S. PATENT DOCUMENTS 3,656,144 4/1972 Forte ..... 340/571
4,204,202 5/1980 Pai ..... 340/571
4,272,763 6/1981 Chang et al. ..... 340/571
4,728,937 3/1988 Hsy ..... 340/571
5,027,105 6/1991 Dailey et al. ..... 340/571

*Primary Examiner*—Donnie L. Crosland
*Attorney, Agent, or Firm*—Thomas I. Rozsa

[57] ABSTRACT

The present invention is a compact security alarm circuitry and apparatus for a portable container comprising a power unit, an alarm unit, a switch unit and a sensor unit all connected in series, whereby the sensor unit can detect an alert event and switch on to activate the alarm unit. It may further comprise a latch unit for keeping the alarm unit activated once the alert event has occurred even if the sensor unit later switches off. It may be built into the portable container, or further comprises housing means for housing the compact security alarm circuitry and apparatus and attaching means for attaching the housing means onto the portable container.

20 Claims, 2 Drawing Sheets

Fig. 1.
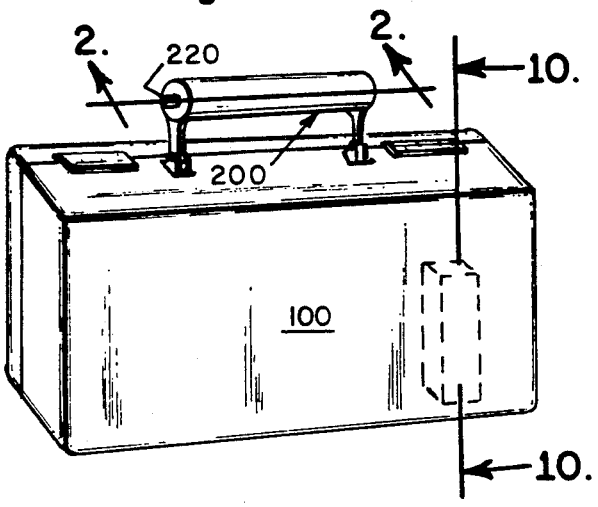
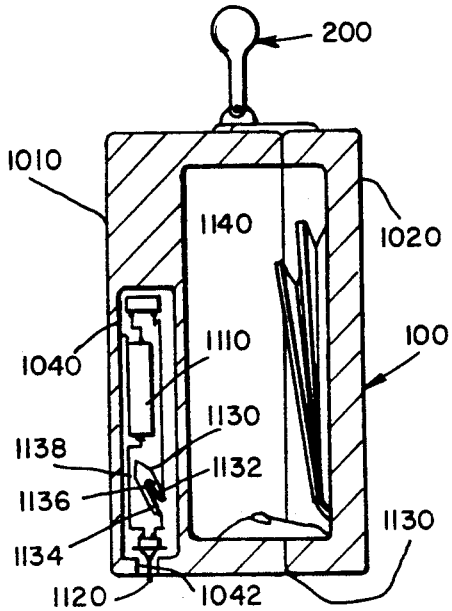
Fig. 10.
Fig. 2.
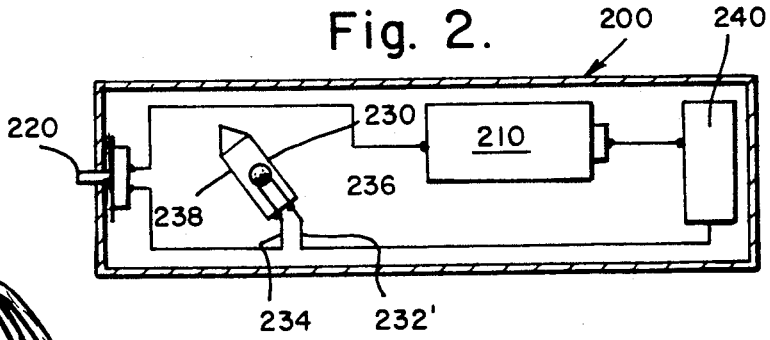
Fig. 3.
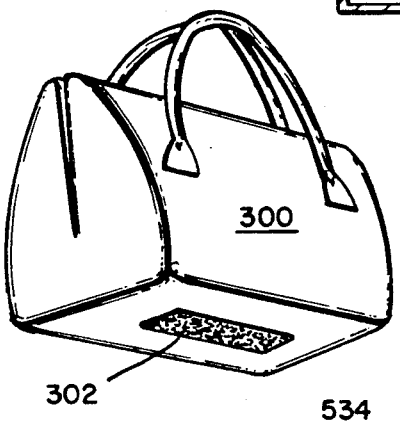
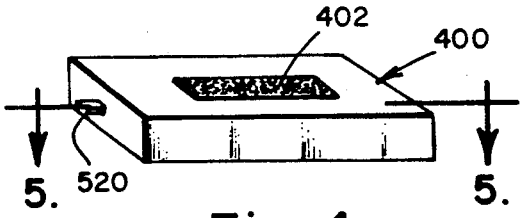
Fig. 4.
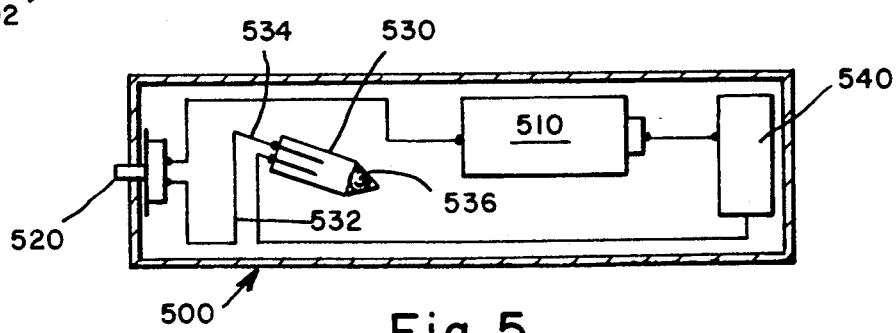
Fig. 5.

610
600
620
632
640
630
634

710
720
764
768
740
750
730
762
766
700

764
768
S1
S2
800
762
K
766

764
768
Q2
Q1
R4
R3
R1
900
762
R2
766

COMPACT SECURITY ALARM CIRCUITRY AND APPARATUS FOR PORTABLE CONTAINERS

BACKGROUND OF THE INVENTION

1. Field of the Invention

The present invention relates to the field of security alarm circuitry and apparatus. More particularly the present invention relates to the field of security alarm circuitry and apparatus for portable containers.

2. Description of Prior Art

Personal portable containers, such as briefcases and handbags, are widely used and carried. They often contain valuable personal items, such as passports, money, credit cards and jewelry. They also often contain important business documents, such as marketing plans, financial statements and profit reports. People cannot afford to lose their briefcases or handbags but in many instances these things are just striking targets for thieves. One way to protect the personal properties contained in such portable containers is to add locking devices for preventing unauthorized access to the container, such as the numerical locks used on briefcases. But once a locked briefcase is stolen by a thief and is in the possession of the thief, he is going to do everything he can to break the lock of the briefcase which can be easily accomplished. It would be best to prevent the briefcase from being stolen in the first place. It would be ideal if people can always hold their briefcases or handbags in their hand at all times. Unfortunately it is not always possible or convenient to do so. For example, at an airport ticket counter a businessman often puts his briefcase aside so he can free his hands to purchase an airplane ticket or do other things. A lady in a washroom sometimes puts her handbag on the counter when she is washing her hands or doing her make-up. It is quite common for these briefcases or handbags that are put aside even for a brief moment to be quickly stolen. It will be useful to have some sort of alarm apparatus attached to the briefcases, handbags and the like portable containers for protection against theft.

Many kinds of security alarm circuitry and apparatus have been introduced and manufactured for years. Typically a conventional security alarm circuitry and apparatus has the following essential components: a power unit for energizing the entire apparatus, which is usually an AC or a DC electrical power source; a switch unit for turning the apparatus on and off; a sensor unit for detecting the alarming situation, which may be a mechanical, electrical, thermal or optical sensing device; and an alarm unit for alerting the user if the alarming situation exists, which may be an auditory alarm or a visual alarm. Installing a security alarm circuitry and apparatus is a very effective way to prevent property losses caused by burglary. However, while there are numerous kinds of security alarm circuitry and apparatus available for properties such as buildings, automobiles, yachts and electronic equipment, there is no compact security alarm circuitry and apparatus available now which is specially designed, produced and used for portable containers such as briefcases and handbags to provide necessary protection against theft.

SUMMARY OF THE PRESENT INVENTION

The present invention is a compact security alarm circuitry and apparatus for portable containers.

It is known that portable containers such as briefcases and handbags containing valuable items are often quickly stolen by thief when being placed aside by the owners even for a very short moment. It is also known that security alarm circuitry and apparatus are very effective for protection against burglary. It is desirable to equip a portable container with a security alarm circuitry and apparatus which alerts the owner if and when the portable container is moved without authorization.

It has been discovered, according to the present invention, that if a portable container has a compact security alarm circuitry and apparatus which can sense the sudden movement or change of position of the portable container that usually occurs when somebody grabs the portable container and produces an auditory alarm signal, then the auditory signal will alert the owner of the portable container for the situation.

It has also been discovered, according to the present invention, that if a compact security alarm circuitry and apparatus can be either built into a portable container or detachably attached to the portable container, then the original configuration of the portable container can remain unchanged.

It has further been discovered, according to the present invention, that if a compact security alarm circuitry and apparatus built in or attached to a portable container has a secret switch at a location on the portable container which is hidden from the view of others and only known to the owner of the portable container, then the owner can turn the compact security alarm circuitry and apparatus on or off as desired without other people seeing this.

It has additionally been discovered, according to the present invention, that if a compact security alarm circuitry and apparatus for portable containers also has a latch means to keep the alarm sounding long after the situation that initiated the alarm has disappeared, then the person who steals the portable container cannot stop the alarm by holding the container still or return it back to its original orientation.

It is therefore an object of the present invention to provide a compact security alarm circuitry and apparatus for portable containers which can sense the sudden movement or change of the orientation of a portable container and alert the owner with an auditory sounder if the situation occurs.

It is also an object of the present invention to provide a compact security alarm circuitry and apparatus for portable containers which can be either built-in or detachably attached to a portable container without altering the original configuration of the portable container.

It is a further object of the present invention to provide a compact security alarm circuitry and apparatus for portable containers which has a secret switch hidden from view for turning the compact security alarm circuitry and apparatus on or off as desired.

It is an additional object of the present invention to provide a compact security alarm circuitry and apparatus for portable containers which also has a latch means to keep the alarm sounding long after the situation that initiated the alarm has disappeared.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of a briefcase, where one of the embodiments of the present invention security alarm circuitry and apparatus is built into the handle of the briefcase.

FIG. 2 is a cross-sectional view taken along line 2—2 of FIG. 1.

FIG. 3 perspective view of a handbag, where a female VELCRO mating member is affixed at the bottom of the handbag for attachment of the present invention security alarm circuitry and apparatus.

FIG. 4 is a perspective view of a small box containing another embodiment of the present invention, where a male VELCRO mating member is affixed at the top of the small box for attaching the small box to the bottom of the handbag illustrated in FIG. 3.

FIG. 5 is a cross-sectional view taken along line 5—5 of FIG. 4.

FIG. 10 is a cross-sectional view taken along line 10—10 of FIG. 1 showing another embodiment of the present invention.

DETAILED DESCRIPTION OF THE PREFERRED EMBODIMENT

Figures 6, 7, 8, 9:
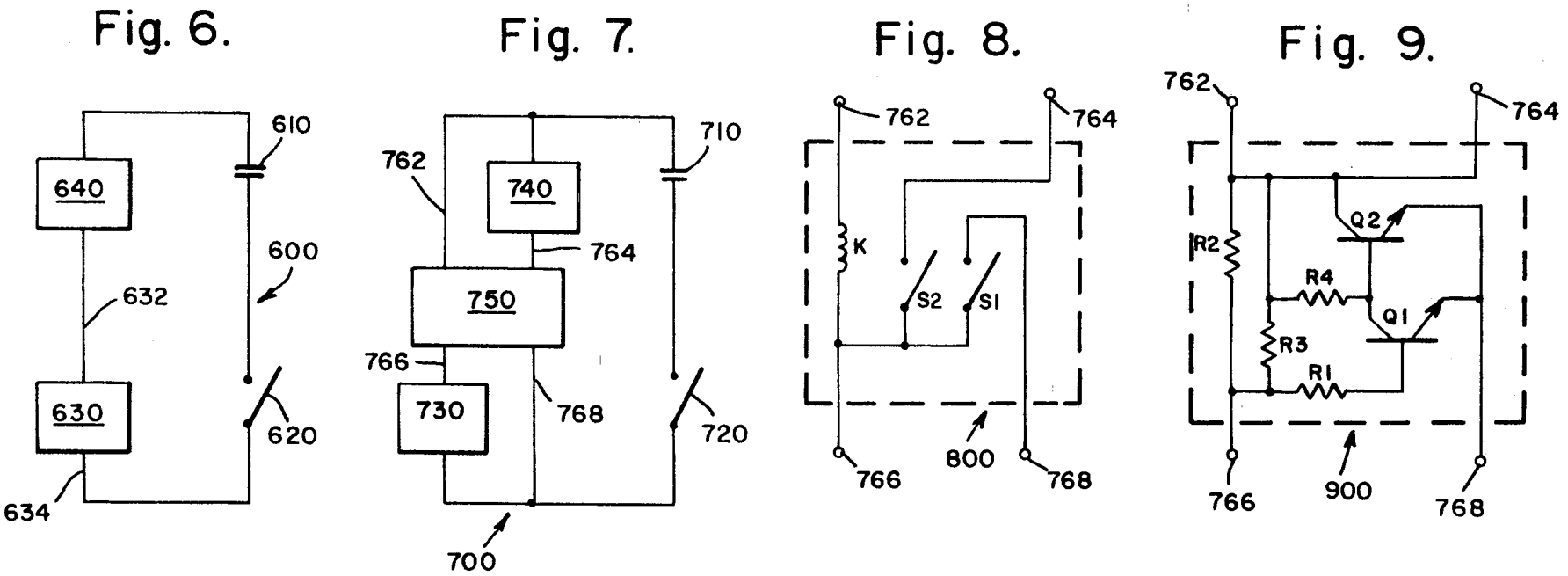
FIG. 6 is a schematic diagram of the circuitry of one of the embodiments of the present invention.
FIG. 7 is a schematic diagram of an alternative circuitry of the present invention.
FIG. 8 is a schematic diagram of the circuitry of the optional latch means of the present invention.
FIG. 9 is a schematic diagram of an alternative circuitry of the optional latch means of the present invention.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is shown at 100 a briefcase which has a handle 200, where one of the embodiments of the present invention security alarm circuitry and apparatus is built into handle 200 of briefcase 100 with a secret switch 220 at one end of handle 200. FIG. 2 is a cross-sectional view taken along line 2—2 of FIG. 1. In FIG. 2 there is shown that the present invention security alarm circuitry and apparatus is built into handle 200. Inside handle 200 there is a battery 210, a switch 220, a sensor 230 and an alarm 240. Battery 210 may be replaced by any electric power source capable of supplying DC current adequate to energize alarm 240. It is normally 3 volts DC to 30 volts DC. By way of example, battery 210 may be a nine volt battery. Sensor 230 is a device which detects either sudden movement, change of position or weight of the container, or combinations of the above-mentioned situations. It may be a magnetic reed switch, a mercury switch, a balanced ball switch, or a microswitch, etc.. By way of example, sensor 230 is a mercury switch with a tubular housing 238. At one tapered end of tubular housing 238 there is a small mercury ball 236 and at the other end of tubular housing 238 there are two isolated wires 232 and 234. Wire 232 is connected to alarm 240 and wire 234 is connected to switch 220. Tubular housing 238 is so oriented that when handle 200 is in the upright position mercury ball 236 rolls toward the center of tubular housing 238 and touches wires 232 and 234, and when handle 200 is in the horizontal position mercury ball 236 rolls toward and rests at the tapered end of tubular housing 238 and does not contact wires 232 and 234. If a user has to put briefcase 100 aside, the user can leave handle 200 in the down horizontal position and then turn secret switch 220 on to engage the security alarm circuitry and apparatus. Switch 220 is hidden from the view of other people so nobody will notice that the user has engaged the security alarm circuitry and apparatus. Now mercury ball 236 rests at the tapered end of tubular housing 238 of sensor 230 so there is no connection between wires 232 and 234, and alarm 240 is off. If somebody tries to steal briefcase 100 and lifts handle 200 to its upright position, mercury ball 236 will roll toward the center of tubular housing 238 of sensor 230 and contact wires 232 and 234 simultaneously which in turn makes connection between wires 232 and 234. As soon as wires 232 and 234 are connected, alarm 240 will be on and provide an auditory signal to alert the user. By way of example, alarm 240 may be similar to components used in beepers, computers, timers and other devices where a high pitched sound is used to gain the attention of the user. It may be a piezo-beeper, a vibrating reed or other electronic alarm devices.

Referring to FIG. 3, there is shown at 300 a handbag with a female VELCRO-R or loop mating member 302 affixed at the bottom. Referring to FIG. 4, there is shown a small box 400 containing the present invention security alarm circuitry and apparatus. A male VELCRO-R or hook mating member 402 is affixed at the top of small box 400 so small box 400 may be detachably attached to the bottom of handbag 300. Other attaching means such as double-back tape may also be used. Switch 520 is again hidden from view. FIG. 5 is a cross-sectional view taken along line 5—5 in FIG. 4, which shows another embodiment of the present invention security alarm circuitry and apparatus. It comprises a battery 510, a switch 520, a sensor 530 and an alarm 540, which are all similar to the components shown in FIG. 2. Sensor 530 may again be a mercury switch which has two wires 532 and 534, a mercury ball 536 and a tubular housing 538. The difference is in the orientation of tubular housing 538. The tapered end of tubular housing 538 is now a little bit tilted downwardly. When the top of small box 400 containing the security alarm circuitry and apparatus is attached to the bottom of handbag 300 and handbag 300 is left in a upright position, mercury ball 536 is resting at the tapered end of tubular housing 538. As soon as handbag 300 is suddenly lifted and the orientation of tubular housing 538 has changed consequently, mercury ball 536 will roll toward the center of tubular housing 538 and contacts wires 532 and 534 which in turn makes the circuit connected and alarm 540 will sound.

FIG. 6 is the schematic diagram of the electronic circuitry of the two embodiments of the present invention shown in FIG. 2 and FIG. 5. Circuitry 600 comprises a power unit 610, a switch unit 620, a sensor unit 630 and an alarm unit 640, all connected in series. As discussed, above power unit 610 may be a battery, sensor unit 630 may be a mercury switch, and alarm unit 640 may be a piezo-beeper.

Sensor unit 630 essentially detects sudden movements or position changes. However if the causes have ceased, sensor unit 630 will cut off the circuit connection. For example, if a thief lifts a briefcase which makes the alarm sound, the thief may turn the handle back to a down horizontal position and carry the body of the briefcase. This will make sensor unit 630 go back to its original orientation or configuration, which cuts off the alarm circuit. The brief sound of the alarm unit may not be long enough to alert the owner of the briefcase. To avoid this situation an optional latch unit may be used in addition to the circuitry shown in FIG. 6. As shown in FIG. 7 a latch unit 750 is added into an alternative circuitry 700 of the present invention security alarm circuitry and apparatus. Latch unit 750 is connected to the power unit 710, the switch unit 720, the sensor unit 730 and the alarm unit 740 by wires 752, 758, 756 and 754 respectively. The function of latch unit 750 is to keep the alarm remaining activated even after the event which initiated the alarm has disappeared. Without latch unit 750, alarm unit 740 would cease sounding once the event ceased. Latch unit 750 may comprise relays or flip-flop semiconductors either as discrete components or integrated circuits.

Referring also to FIG. 8, there is shown at 800 a circuitry of the optional latch unit. Circuit 800 comprises a relay K and two switches S1 and S2. Switches S1 and S2 may be replaced by a double-pole double-throw switch. Relay K is connected between sensor 730 at 766 and the positive terminal of power source 710 at 762. Switch S1 is connected between manual switch 720 at 768 and sensor 730 at 766. Switch S2 is connected between alarm 740 at 764 and sensor 730 at 766. Initially switches S1 and S2 are open. After manual switch 520 is switched on, if sensor 730 senses an alert event and connects the circuit, then a DC current goes through relay K, which in turn pulls switches S1 and S2 to their closed position. Once S1 and S2 are closed, even if the alert event has disappeared and sensor 730 no longer connects the circuit, alarm 740 is still connected through switch S1 and S2 thus continuously providing an alarm signal, and relay K also remains connected through switch S1 thus continuously pulling switches S1 and S2 closed. The apparatus can be disengaged by manually turning off switch unit 720.

In FIG. 9 shown at 900 there is an alternative circuitry of the latch unit. Circuitry 900 comprises two transistors Q1 and Q2 and four resistors R1, R2 R3, and R4. Resistor R1 is connected between sensor 730 at 766 and the base of transistor Q1. Resistor R2 is connected between sensor 730 at 766 and the positive terminal of power source 710 at 762. Resistor R3 is connected between the positive terminal of power source 710 at 762 and resistor R1. Resistor R4 is connected between the positive terminal of power source 710 at 762 and base of transistor Q2. The collector of transistor Q1 is connected to the base of transistor Q2. The collector of transistor Q2 is connected to alarm 740 at 764 and resistor R2 at 762. The emitters of both transistor Q1 and Q2 are connected to manual switch 710 at 768. When an alert event occurs and sensor unit 730 connects the circuit, the low voltage at the base of transistor Q1 puts transistor Q1 in an OFF status which in turn produces a high voltage at the collector of transistor Q1, which is also at the base of transistor Q2. The high voltage at the base of transistor Q2 will put transistor Q2 in an ON status, so the alarm unit is connected through and provides an alarm to the user. Once transistor Q2 is ON, the voltage at the collector of transistor Q2 is low so that the base of transistor Q1 is biased low which in turn keeps transistor Q1 in the OFF status. Transistor Q1 remaining at the OFF status makes transistor Q2 remaining at the ON status, therefore even if the alert event has disappeared and sensor 730 no longer connects the circuit, alarm 740 is still connected through transistor Q2 thus continuously providing an alarm signal. This situation will only be changed when manual switch 710 is cut-off.

Another embodiment of the present invention is having the compact security alarm apparatus installed inside one of the walls of a briefcase or like container. Referring to FIG. 10, a cross-sectional view is taken along line 10—10 of FIG. 1. A briefcase is constructed with a top piece 1010 and a bottom piece 1020 hinged together by hinge 1030. The compact security alarm apparatus is installed inside a hollow chamber 1040 of bottom piece 1010 of the briefcase. The alarm apparatus comprises a battery 1110, a switch 1120, a sensor 1130 and an alarm 1140. There is a small opening 1042 at bottom piece 1010 connected to chamber 1040 so secret switch 1020 can be reached. Sensor 130 is similar to sensor 230 shown in FIG. 2 but is oriented differently now, such that when the brief case is placed in a flat position on its bottom piece, small mercury ball 1136 will rest at the closed end of small housing 1138 so even if switch 1120 is turned on the circuit is still cut off. If the brief case is lifted up in an upright position, then small mercury ball 1136 will roll down to contact the two wires 1132 and 1134 which in turn connects the circuit and activates alarm 1140 to alert the user of the unauthorized movement.

The present invention has many advantageous features including: (1) it provides a compact security alarm circuitry and apparatus for portable containers such as briefcases and handbags which often contain valuable items and are often very attractive targets for thieves; (2) it is compact in size and light-weight, so it can be either built into various parts of a portable container or detachably attached to a portable container; (3) it has an optional latch means to keep the alarm sounding even long after the event causing the alarm has ceased; (4) it can be engaged without the notice of others by being secretly switched on through a switch hidden from the view of others; (5) it is long lasting and easy to maintain.

Defined in detail, the present invention is a compact security alarm circuitry and apparatus built into the handle of a briefcase comprising: (a) a nine volt battery having a positive terminal and a negative terminal; (b) a piezo-beeper connected to said positive terminal of said nine volts battery; (c) a slide switch connected to said negative terminal of said nine volt battery; and (d) a mercury switch connected between said slide switch and said piezo-beeper where the mercury switch can detect the position change of the handle of the briefcase and switch on; (e) whereby when said slide switch is switched on, if the position of the handle of the briefcase is changed, said mercury switch will switch on and said piezo-beeper will provide an auditory alert signal.

As an alternative embodiment defined in detail, the present invention is a compact security alarm circuitry and apparatus for a handbag comprising: (a) a nine volt battery having a positive terminal and a negative terminal; (b) a piezo-beeper connected to said positive terminal of said nine volt battery; (c) a slide switch connected to said negative terminal of said nine volt battery; (d) a sensor device connected between said slide switch and said piezo-beeper where the sensor device can detect the sudden movement of the handbag and switch on; (e) a small container for housing said nine volt DC battery, said piezo-beeper, said slide switch and said sensor device; and (f) an attaching means for detachably attaching said small container onto the handbag; (g) whereby when said mechanical switch is switched on, if the handbag is suddenly moved, said sensor device will switch on and said piezo-beeper will provide an auditory alert signal.

In the alternative embodiment of the present invention defined in detail, the sensor device may be a mercury switch or a balanced ball switch; the container may be a small box made of plastic material or thick nylon material; the attaching means may be a piece of double-back tape, or comprise a male hook-like mating member attached to said small box and a female loop-like mating member attached to the handbag.

As another alternative embodiment defined in detail, the present invention is a compact security alarm circuitry and apparatus built into a side wall of a briefcase comprising: (a) a nine volt battery having a positive terminal and a negative terminal; (b) a piezo-beeper connected to said positive terminal of said nine volt battery; (c) a slide switch connected to said negative terminal of said nine volt battery; and (d) a mercury switch connected between said slide switch and said piezo-beeper where the mercury switch can detect the orientation change of the handle of the briefcase and switch on; (e) whereby when said slide switch is switched on, if the orientation of the briefcase is changed, said mercury switch will switch on and said piezo-beeper will provide an auditory alert signal.

Defined broadly, the present invention is a compact security alarm circuitry and apparatus built into the handle of a briefcase comprising: (a) a DC power source having a positive terminal and a negative terminal; (b) an auditory sounder connected to said positive terminal of said DC power source; (c) a manual switch connected to said negative terminal of said DC power source; and (d) a sensor device connected between said manual switch and said auditory sounder where the sensor device can detect the position change of the handle of the briefcase and switch on; (e) whereby when said manual switch is switched on, if the position of the handle of the briefcase is changed, said sensor device will switch on and said auditory sounder will be activated and provide an auditory alert signal.

As an alternative embodiment defined broadly, the present invention is a compact security alarm circuitry and apparatus for a handbag comprising: (a) a DC power source having a positive terminal and a negative terminal; (b) an auditory sounder connected to said positive terminal of said DC power source; (c) a manual switch connected to said negative terminal of said DC power source; (d) a sensor device connected between said manual switch and said auditory sounder where the sensor device can detect the sudden movement of the handbag and switch on; (e) a small container for housing said DC power source, said auditory sounder, said manual switch and said sensor device; and (f) an attaching means for detachably attaching said small container onto the handbag; (g) whereby when said manual switch is switched on, if the handbag is suddenly moved, said sensor device will switch on and said auditory sounder will provide an auditory alert signal.

As another alternative embodiment defined broadly, the present invention is a compact security alarm circuitry and apparatus built into a side wall of a briefcase comprising: (a) a DC power source having a positive terminal and a negative terminal; (b) an auditory sounder connected to said positive terminal of said DC power source; (c) a manual switch connected to said negative terminal of said DC power source; and (d) a sensor device connected between said manual switch and said auditory sounder where the sensor device can detect the orientation change of the briefcase and switch on; (e) whereby when said manual switch is switched on, if the orientation of the briefcase is changed, said sensor device will switch on and said auditory sounder will be activated and provide an auditory alert signal.

The present invention defined broadly may further comprise a latch means. One embodiment of the optional latch means of the present invention comprises: (a) a relay connected between said positive terminal of said DC power source and said sensor device; (b) a first switch connected parallel to said sensor device and located close to said relay; and (c) a second switch connected between said auditory sounder and said sensor device and located close to said relay; (d) whereby said relay will make said first switch and said second switch close once said sensor device switches on, so that said latch means will keep said auditory sounder activated even after said sensor device later switches off.

An alternative embodiment of the optional latch means of the present invention comprises: (a) a first transistor and a second transistor, where the emitters of the first transistor and the second transistor are connected to said manual switch, the base of the second transistor is connected to the collector of the first transistor and the collector of the second transistor is connected to said auditory sounder; and (b) a first resistor connected between the base of said first transistor and said sensor device, a second resistor connected between said positive terminal of said DC power source and said sensor device, a third resistor connected between said collector of said second transistor and said sensor device, and a fourth resistor connected between the base of said second transistor and said positive terminal of said DC power source; (c) whereby said latch means will keep said auditory sounder activated even after said sensor device later switches off.

Defined more broadly, the present invention is a compact security alarm circuitry and apparatus for a portable container comprising a power unit, an alarm unit, a switch unit and a sensor unit all connected in series, whereby the sensor unit can detect an alert event and switch on to activate the alarm unit. It may further comprise a latch unit for keeping said alarm unit activated once the alert event has occurred even if said sensor unit later switches off.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A compact security alarm circuitry and apparatus built into the handle of a briefcase comprising:
   a. a DC power source having a positive terminal and a negative terminal;
   b. an auditory sounder connected to said positive terminal of said DC power source;
   c. a manual switch connected to said negative terminal of said DC power source; and
   d. a sensor device connected between said manual switch and said auditory sounder where the sensor device can detect the position change of the handle of the briefcase and switch on;
   e. whereby when said manual switch is switched on, if the position of the handle of the briefcase is changed, said sensor device will switch on and said auditory sounder will be activated and provide an auditory alert signal.

2. The invention as defined in claim 1 wherein said DC power source is a battery having a voltage range from three volts to thirty volts.

3. The invention as defined in claim 1 wherein said sensor device is a mercury switch.

4. The invention as defined in claim 1 further comprising a latch means for keeping said auditory sounder activated once the position of the handle of the briefcase has been changed even if said sensor device later switches off.

5. The invention as defined in claim 4 wherein said latch means comprises:
   a. a relay connected between said positive terminal of said DC power source and said sensor device;
   b. a first switch connected parallel to said sensor device and located close to said relay; and
   c. a second switch connected between said auditory sounder and said sensor device and located close to said relay;
   d. whereby said relay will make said first switch and said second switch close once said sensor device switches on, so that said latch means will keep said auditory sounder activated even after said sensor device later switches off.

6. The invention as defined in claim 4 wherein said latch means comprises:
   a. a first transistor and a second transistor, where the emitters of the first transistor and the second transistor are connected to said manual switch, the base of the second transistor is connected to the collector of the first transistor and the collector of the second transistor is connected to said auditory sounder and the positive terminal of said DC power source; and
   b. a first resistor connected between the base of said first transistor and said sensor device, a second resistor connected between said positive terminal of said DC power source and said sensor device, a third resistor connected between said collector of said second transistor and said sensor device, and a fourth resistor connected between the base of said second transistor and said positive terminal of said DC power source;
   c. whereby said latch means will keep said auditory sounder activated even after said sensor device later switches off.

7. A compact security alarm circuitry and apparatus built into a side wall of a briefcase which has a handle, comprising:
   a. a DC power source having a positive terminal and a negative terminal;
   b. an auditory sounder connected to said positive terminal of said DC power source;
   c. a manual switch connected to said negative terminal of said DC power source; and
   d. a sensor device connected between said manual switch and said auditory sounder where the sensor device is located in the handle of the briefcase and can detect the orientation change of the briefcase or the handle and switch on;
   e. whereby when said manual switch is switched on, if the orientation of the briefcase or the handle is changed, said sensor device will switch on and said auditory sounder will be activated and provide an auditory alert signal.

8. The invention as defined in claim 7 wherein said DC power source is a battery having a voltage range from three volts to thirty volts.

9. The invention as defined in claim 7 wherein said sensor device is a mercury switch.

10. The invention as defined in claim 7 further comprising a latch means for keeping said auditory sounder activated once the orientation of the briefcase has been changed even if said sensor device later switches off.

11. The invention as defined in claim 10 wherein said latch means comprises:
   a. a relay connected between said positive terminal of said DC power source and said sensor device;
   b. a first switch connected parallel to said sensor device and located close to said relay; and
   c. a second switch connected between said auditory sounder and said sensor device and located close to said relay;
   d. whereby said relay will make said first switch and said second switch close once said sensor device switches on, so that said latch means will keep said auditory sounder activated even after said sensor device later switches off.

12. The invention as defined in claim 10 wherein said latch means comprises:
   a. a first transistor and a second transistor, where the emitters of the first transistor and the second transistor are connected to said manual switch, the base of the second transistor is connected to the collector of the first transistor and the collector of the second transistor is connected to said auditory sounder ant the positive terminal of said DC power source; and
   b. a first resistor connected between the base of said first transistor and said sensor device, a second resistor connected between said positive terminal of said DC power source and said sensor device, a third resistor connected between said collector of said second transistor and said sensor device, and a fourth resistor connected between the base of said second transistor and said positive terminal of said DC power source;
   c. whereby said latch means will keep said auditory sounder activated even after said sensor device later switches off.

13. A compact security alarm circuitry and apparatus built into the handle of a briefcase comprising:

a. a nine volt battery having a positive terminal and a negative terminal;

b. a piezo-beeper connected to said positive terminal of said nine volt battery;

c. a slide switch connected to said negative terminal of said nine volt battery; and d. a mercury switch connected between said slide switch and said piezo-beeper where the mercury switch can detect the position change of the handle of the briefcase and switch on;

e. whereby when said slide switch is switched on, if the position of the handle of the briefcase is changed, said mercury switch will switch on and said piezo-beeper will provide an auditory alert signal.

14. The invention as defined in claim 13 further comprising a latch means for keeping said piezo-beeper activated once the position of the handle of the briefcase has been changed even if said mercury switch later switches off.

15. The invention as defined in claim 14 wherein said latch means comprises:

a. a light duty reed relay connected between said positive terminal of said nine volt battery and said mercury switch;

b. a first single-pole single-throw switch connected parallel to said mercury switch and located close to said light duty reed relay; and c. a second single-pole single-throw switch connected between said piezo-beeper and said mercury switch and located close to said light duty reed relay;

d. whereby said light duty reed relay will make said first single-pole single-throw switch and said second single-pole single-throw switch close once said mercury switch switches on, so that said latch means will keep said piezo-beeper sounding even after said mercury switch later switches off.

16. The invention as defined in claim 14 wherein said latch means comprises:

a. a first transistor and a second transistor, where the emitters of the first transistor and the second transistor are connected to said slide switch, the base of the second transistor is connected to the collector of the first transistor and the collector of the second transistor is connected to said piezo-beeper and the positive terminal of said nine volt battery; and b. a first resistor connected between the base of said first transistor and said mercury switch, a second resistor connected between said positive terminal of said nine volt battery and said mercury switch, a third resistor connected between said collector of said second transistor and said mercury switch, and a fourth resistor connected between the base of said second transistor and said positive terminal of said nine volt battery;

c. whereby said latch means will keep said piezo-beeper activated even after said mercury switch later switches off.

17. A compact security alarm circuitry and apparatus built into a side wall of a briefcase which has a handle, comprising:

a. a nine volt battery having a positive terminal and a negative terminal;

b. a piezo-beeper connected to said positive terminal of said nine volt battery;

c. a slide switch connected to said negative terminal of said nine volt battery; and d. a mercury switch connected between said slide switch and said piezo-beeper where the mercury switch is located in the handle of the briefcase and can detect the orientation change of the briefcase or the handle and switch on;

e. whereby when said slide switch is switched on, if the orientation of the briefcase or the handle is changed, said mercury switch will switch on and said piezo-beeper will provide an auditory alert signal.

18. The invention as defined in claim 17 further comprising a latch means for keeping said piezo-beeper activated once the orientation of the briefcase has been changed even if said mercury switch later switches off.

19. The invention as defined in claim 18 wherein said latch means comprises:

a. a light duty reed relay connected between said positive terminal of said nine volt battery and said mercury switch;

b. a first single-pole single-throw switch connected parallel to said mercury switch and located close to said light duty reed relay; and c. a second single-pole single-throw switch connected between said piezo-beeper and said mercury switch and located close to said light duty reed relay;

d. whereby said light duty reed relay will make said first single-pole single-throw switch and said second single-pole single-throw switch close once said mercury switch switches on, so that said latch means will keep said piezo-beeper sounding even after said mercury switch later switches off.

20. The invention as defined in claim 18 wherein said latch means comprises:

a. a first transistor and a second transistor, where the emitters of the first transistor and the second transistor are connected to said slide switch, the base of the second transistor is connected to the collector of the first transistor and the collector of the second transistor is connected to said piezo-beeper ant the positive terminal of said nine volt battery; and b. a first resistor connected between the base of said first transistor and said mercury switch, a second resistor connected between said positive terminal of said nine volt battery and said mercury switch, a third resistor connected between said collector of said second transistor and said mercury switch, and a fourth resistor connected between the base of said second transistor and said positive terminal of said nine volt battery;

c. whereby said latch means will keep said piezo-beeper activated even after said mercury switch later switches off.

* * * * *